United States Patent [19]

Reed

[11] 4,443,291

[45] Apr. 17, 1984

[54] FLYING SPLICE APPARATUS

[76] Inventor: Barrie T. Reed, 4200 NW. 35th Ct., Miami, Fla. 33142

[21] Appl. No.: 254,280

[22] Filed: Apr. 15, 1981

[51] Int. Cl.[3] ..... B65H 19/12; B65H 21/00

[52] U.S. Cl. ..... 156/504; 156/505; 242/58.2; 242/58.5; 242/181

[58] Field of Search ..... 156/157, 159, 502, 504, 156/505; 242/58.1, 58.2, 58.5, 181

[56] References Cited

U.S. PATENT DOCUMENTS

| | | | |
|---|---|---|---|
| 3,305,189 | 2/1967 | Butler, Jr. et al. | 156/504 |
| 3,963,191 | 6/1976 | Goodley | 242/156.2 |
| 3,995,791 | 12/1976 | Schoppee | 156/505 |
| 4,131,501 | 12/1978 | Bottcher et al. | 156/504 |
| 4,173,314 | 11/1979 | Curran et al. | 242/58.4 |
| 4,190,483 | 2/1980 | Ryan et al. | 156/504 |
| 4,292,115 | 9/1981 | Jones et al. | 156/505 |

*Primary Examiner*—Michael G. Wityshyn
*Attorney, Agent, or Firm*—Gipple & Hale

[57] ABSTRACT

An apparatus is disclosed for attaching a running web which is withdrawn from a first source of supply to the leader of a fresh web which is stored in a second source of supply through the use of double sticky back adhesive strips. The apparatus comprises a supply frame provided with a conveyor assembly to transport a roll of material along the supply frame and a splicing head assembly mounted to the roll frame. The splicing head assembly has a plurality of idle rollers, a vacuum member adapted to hold the leading end of the fresh web and a cutting and clamping mechanism moveably mounted to the frame of the splicing head assembly. The cutting and clamping mechanism is adapted to be pivoted by a pneumatic cylinder to clamp the trailing web end from the expiring roll to the fresh web under tension and sever the web from the expiring roll between the dispensing roll and the location where the webs are clamped. A spring biased web acceleration arm mounted to the supply frame engages the web of the fresh roll to provide a reservoir of slackened web from the fresh roll allowing the splice joint of the two webs to be pulled away with gradually increasing force thus preventing sudden acceleration force on the splice.

12 Claims, 10 Drawing Figures

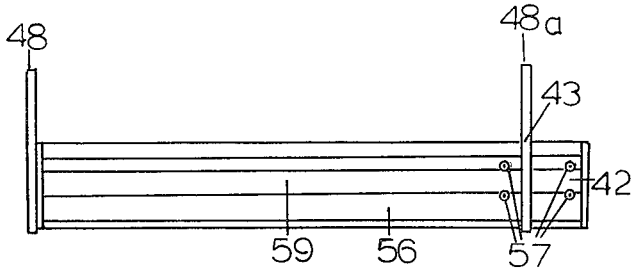
Fig. 3
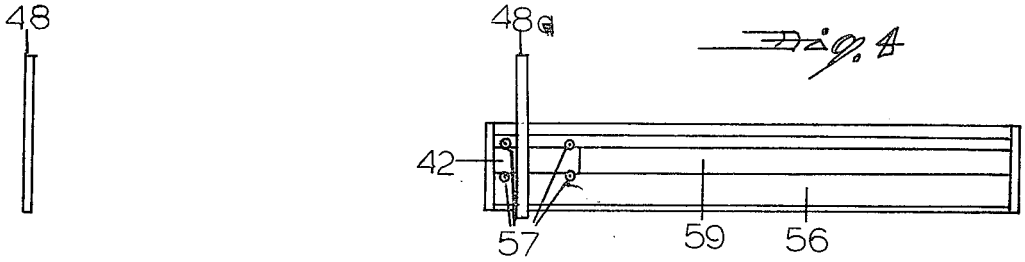
Fig. 4
Fig. 5
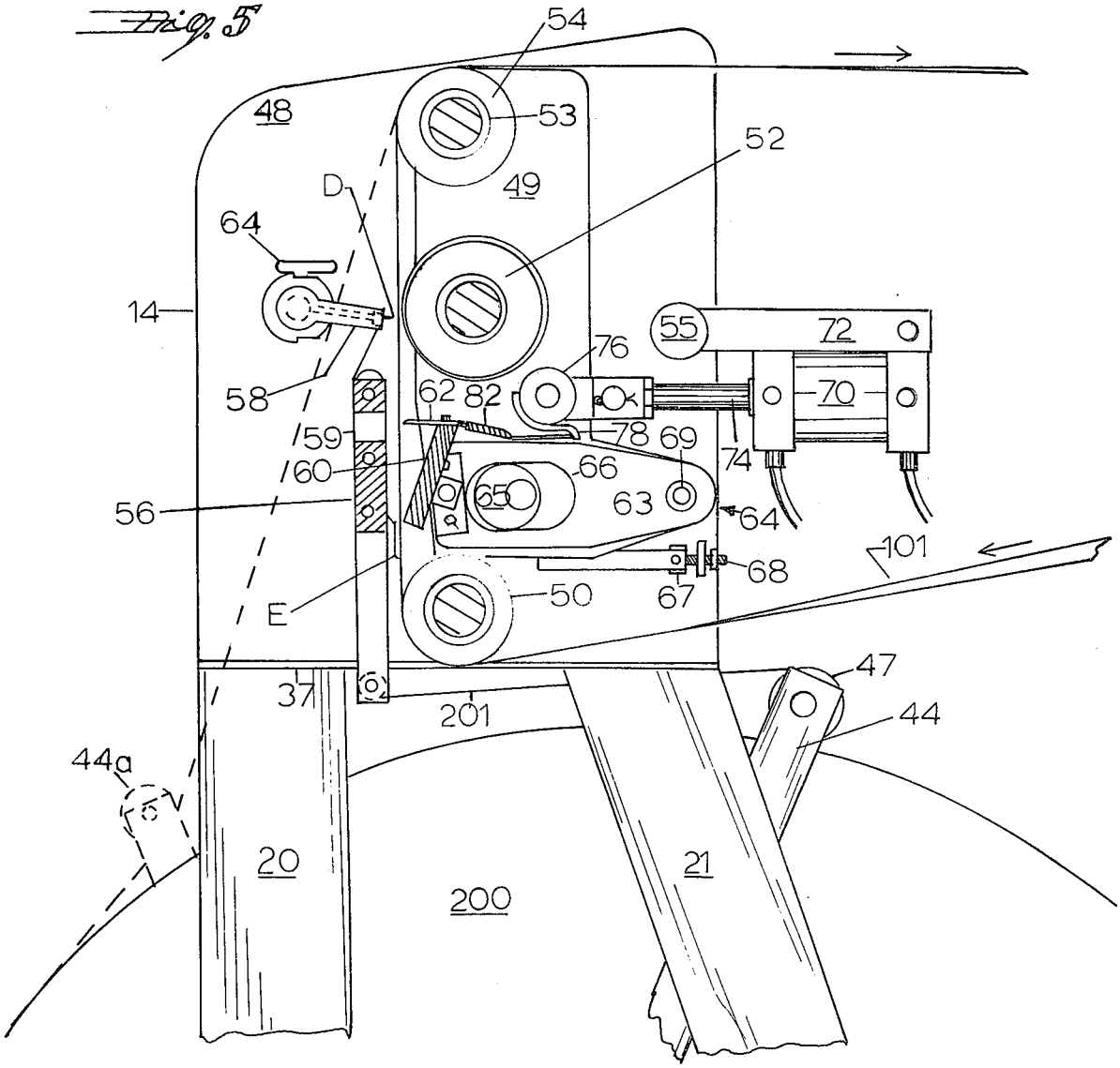

FLYING SPLICE APPARATUS

DESCRIPTION OF THE PRIOR ART

Many types of flexible materials such as paper, plastic, and fabric are formed in rolls and shipped to the end user. Typically, the roll of material is mounted on a roll stand which allows the web of material to unwind so that it can be converted into the finished product. When one roll of material is consumed, the operation is stopped, the expired roll removed from the stand and a new roll mounted so that the manufacturing operation can resume. Generally, the new roll of material is mounted in proximity to the old roll so that the leading end of the web of the new roll can be spliced to the trailing end of the web of the old roll. The splice is then formed through either a manual or an automatic mode.

Manual splices are generally made when the roll of material is stopped or the webs removed at very low speeds.

An automatic web splice is utilized to allow splices to be made when the material webs are moving at much higher speeds. In an automatic web splice apparatus, the leading end of a new roll of material is fastened to the trailing end of the unexpired roll of material while the material is being dispensed with the new or the replacement roll of material being placed on a second roll stand or a duplex roll stand for easy insertion of the leading end of a new roll of material into the automatic splicing machine. As previously noted, the automatic splicing machine, when activated, fastens or splices the leading end of the new replacement roll of material to the web of the expiring roll of material without stopping the moving web thus allowing the packaging process to continue without stopping the packaging apparatus.

Automatic web splicers were originally designed and applied in paper operations. One emphasis was directed towards newspaper printing operations to allow the printing presses to achieve continuous running so as to maintain adequate printing quality which is highly dependent on a constant linear paper speed.

It is also known that automatic web splicers are used in various other industries where continuous running of the web of material is required for high quality production; where handmade splices generate high material waste costs; where lost production time during idle periods for changing of rolls is costly, or where extremely thin web thicknesses are used for wrapping products.

Spliced joints can be either butt, skived, or overlapped at 90 degrees to web flow direction or at some other angle. The joints can be glued, taped, welded, heat sealed, frictionally engaged as with high cling films, woven or mechanically fixed by perforations, or dimpling. Normally the spliced joint must withstand some or all the tension of the web material caused by the pulling of the web materials into subsequent machine operation against the resistance of the unwinding inertia of the roll on the roll stand. Various methods have been used to overcome the difference in speeds between the moving expiring web and the leading end of the new web which is initially at rest.

Thus, automatic splicers basically fall into two categories, namely those that make flying splices and those that make standing splices. The term flying splice refers to the practice of accelerating the leading edge of a new web from a stand still up to or approximating the linear speed of the expiring or trailing end of the web before the splice joint is formed. The linear speed of the new web may equal the linear speed of the expiring web or it may be some fraction of that speed either higher or lower. The leading edge of the new web is moving before the spliced joint is formed during the flying splice. On automatic web splicers utilizing the flying splice, the leading end of the new web is accelerated to the desired linear speed either by pulling or pushing the web. Pulling is often accomplished through the use of a set of driven pinch rollers which grasp the web from the top and bottom of the sheet and through rotation pull the web to speed. Pushing is normally accomplished by driving the roll of material on the roll stand and inducing an acceleration on the roll of material which is transmitted to the leading edge of the new web. Both methods can be singly used or combined depending upon the desired usage.

In a standing splice, the leading edge of the new web is at rest until the splice joint is formed whereupon the new web is accelerated to the linear speed of the expiring web. On automatic web splicers utilizing standing splice practices two methods can be used to make the splice joint. At slow linear speeds, the new resting or stationary web can be clamped or joined together to the moving expiring web. The strength of the splice joint and the web material on either side of the joint is sufficient to resist the sudden tension required to accelerate the new roll of material up to the existing linear speed of the expiring web. No attempt is made to reduce the speed differential between the moving web and the standing web.

At higher speeds, automatic web splicers often utilize an accumulation or a roll system (or festoon) on the expiring web. When the splice is to be made the festoon is collapsed momentarily to provide a reservoir of material in the expiring web. The trailing edge of this reservoir material can then be grasped, held at zero speed while the splice joint is formed and the remainder of the reservoir used to provide a controlled rate of acceleration to the new web.

The following prior art references disclose many of the concepts which have been discussed above.

U.S. Pat. No. 2,987,108 discloses a web butt splicer having two reciprocating blade assemblies on opposite sides of the web path. Overlapping webs flow through a web path between the blade assemblies, and the blade assemblies slice the web to create abutting ends of old and new web portions. As the assemblies reciprocate, pressure pads bearing adhesive tape move to either side of the abutted webs, and press the tapes into the webs across the splice. Another pressure pad adheres to the leading edge of the new web in front of the splice and removes the leading edge after tape is applied.

U.S. Pat. No. 4,010,911 discloses a splicer for webs in which old and new webs moving past opposite sides of a two-sided adhesive strip are cut so that both webs overlap the strip. The webs are then pressed to the strip until secure contact is made, and the old web pulls the strip and the new web through and out of the apparatus. Pivoting arms force the webs past fixed knives and on to the adhesive strip in the apparatus.

U.S. Pat. No. 4,169,752 discloses a web splicing apparatus including sliding accumulator rolls which provide temporary old web slack while the apparatus feed is decelerated to produce a splice. At the splicing location, the old web is fed around a first freewheel roller adjacent a second freewheel roller which the new web attaches to. The new web is sandwiched between a magnetic bar and magnets embedded in the second freewheel roller. The leading edge of the new web bears a doublesided adhesive strip facing the old web. The two freewheel rollers are pressed together until the adhesive strip contacts the old web, which carries the new web and the bar around and off of the first roller to a knife blade which catches the bulge in the old web created by the bar and severs the trailing portion of the old web. The bar also falls away, leaving an overlap splice with sandwiched adhesive.

U.S. Pat. No. 3,918,655 discloses a festooner roller arrangement for a splicing mechanism. Two parallel rows of rollers are mounted on common bars, which bars may move toward one another during a splicing operation in order to maintain a constant web output rate while the old web is slowed for splicing to the new web.

U.S. Pat. No. 4,170,506 discloses a paper web splicing system in which the old web passes around a first roller and the new web is held to a second roller. A double-sided adhesive strip is placed on the leading edge of the new web facing the old web, and the two rollers are driven to contact. The edge of the old web upstream from the splicing point is then severed and the rollers separated so that the old web draws the overlap splice and the new web through the system.

SUMMARY OF THE INVENTION

The present invention relates to an automatic splicer and is specifically directed towards a standing automatic splicer which provides for the speed differential between the moving trailing web and a new standing replacement web without the use of festoon or accumulator rolls. The present invention comprises a duplex roll stand with an integrally mounted splicer. A reduction in the speed differential between the trailing moving web and the standing replacement web is provided through the use of a spring loaded arm mechanism mounted on the roll stand. When the old roll has reached its expiration diameter and is about to be completely used up, a new roll which is mounted on the duplex roll stand is first fed around a swing arm of the mechanism back to the invention and held ready for the splice. The trailing end of the web is held ready for the splice and passes under a knife. At the moment of splice the old web is cut by the knife and a new web is fixed to the moving material at the splice point. This creates a tension in the web which is threaded around the swing arm. The spring loaded swing arm moves in a specific direction to absorb this tension with the web material forming a reservoir which is consumed while allowing the new roll to accelerate gently up to the machine speed against the tension of the spring loaded arm. Thus the possibility of the web being broken at the splice point is significantly diminished.

It can thus be seen that the invention provides a simple, compact, inexpensive, rugged and reliable splicing apparatus which can be used for splicing deformable webs.

Furthermore, the invention provides an apparatus which splices webs with minimum downtime and with a minimum of material loss.

The above-mentioned purposes and operations of the invention are more readily apparent when read in conjunction with the following description of the drawings and the detailed description of the preferred embodiment of the present invention.

BRIEF DESCRIPTION OF THE DRAWINGS

FIG. 3 is an isolated view of the knife backup bar mechanism of the splicer assembly in a closed position within the splicer head assembly;

FIG. 4 is another isolated view of the backup knife bar mechanism shown in an extended position removed from the interior of the splicer head assembly;

FIG. 5 is an enlarged cross sectional view of the splicer head assembly shown in FIG. 2;

DETAILED DESCRIPTION OF THE DRAWINGS

Figure 1:
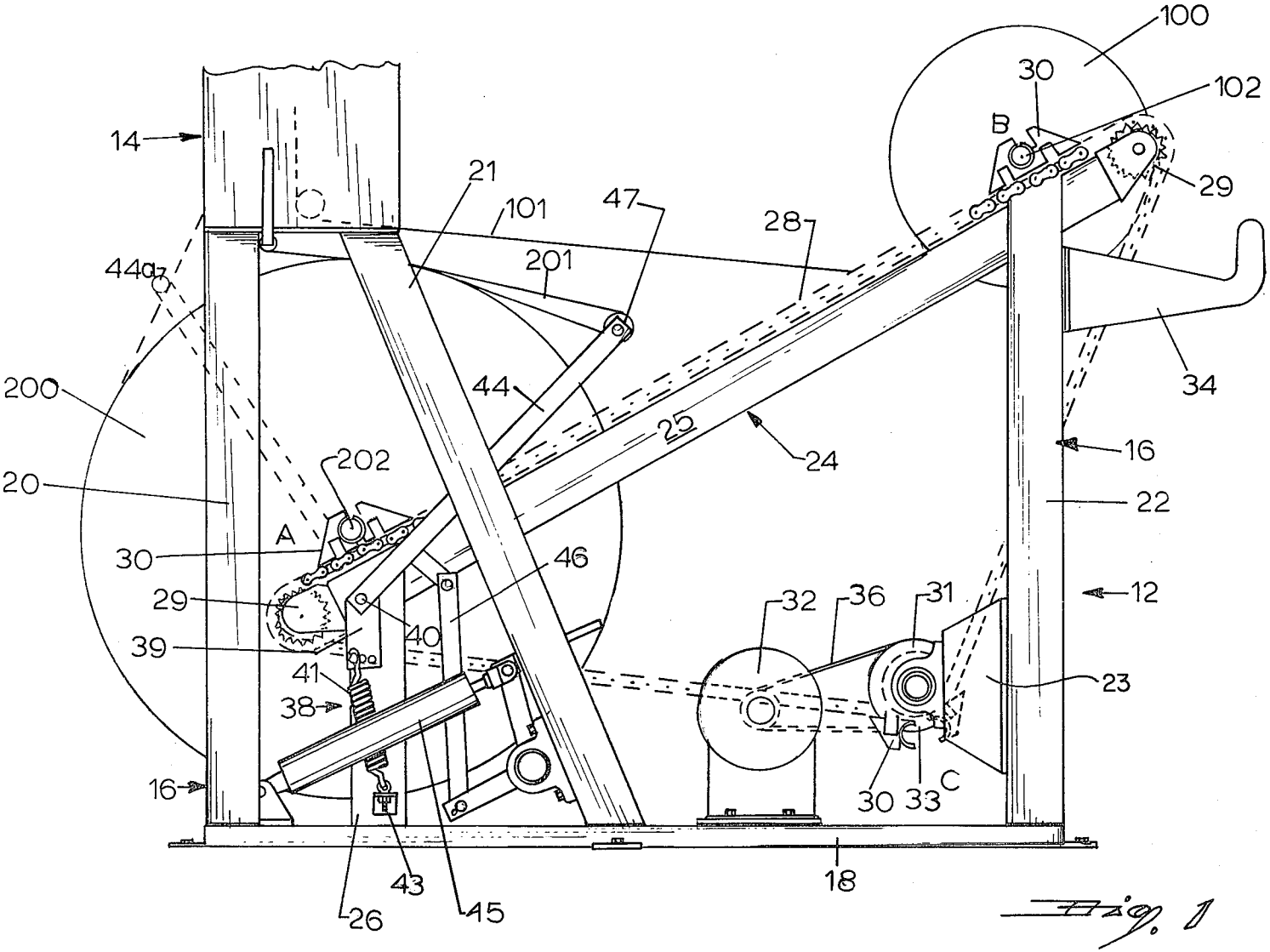
FIG. 1 is a side elevational view partially in phantom of the splicing apparatus with the splicer head assembly partially broken away.
Figure 2:
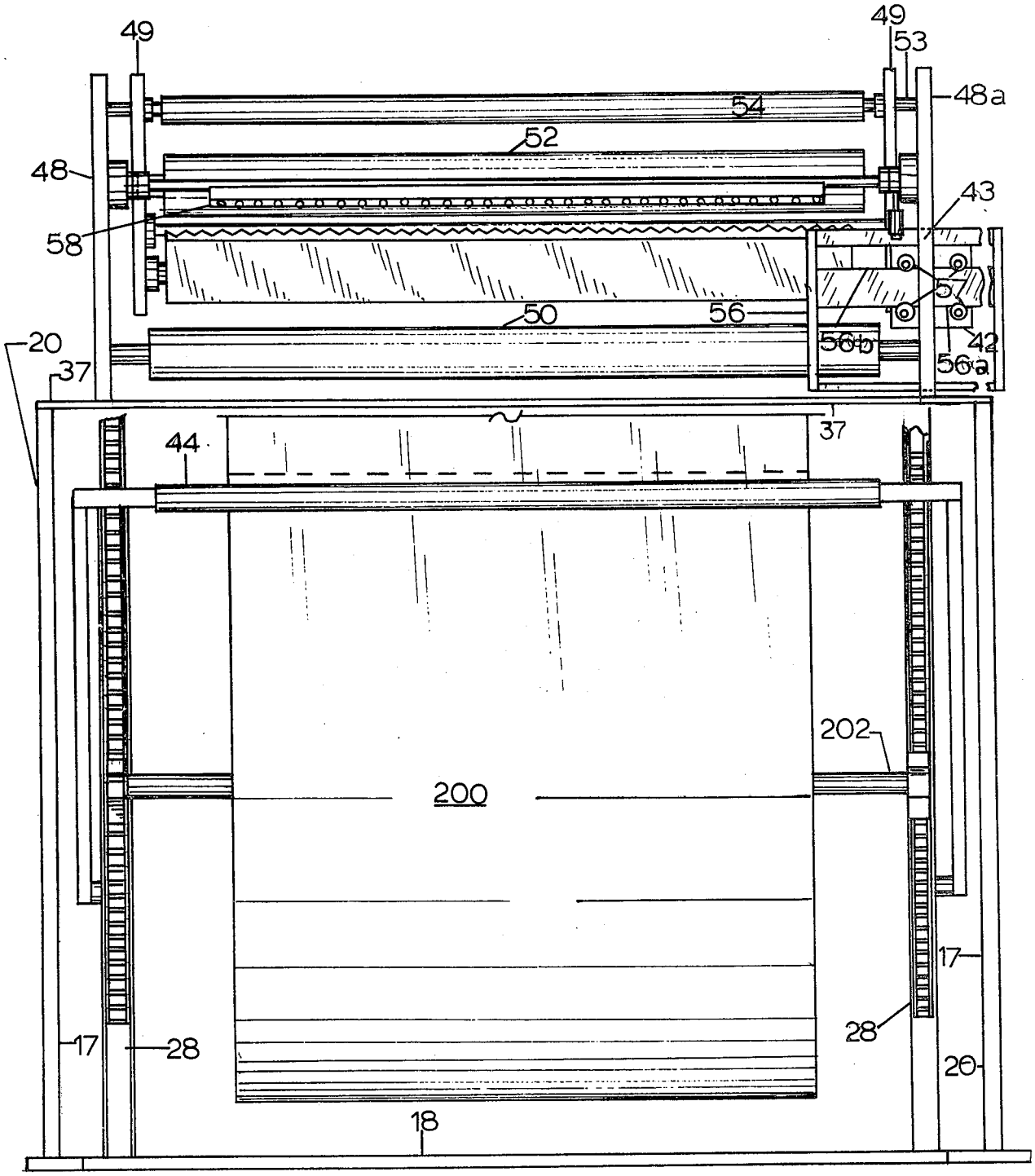
FIG. 2 is an enlarged front elevational view of the apparatus shown in FIG. 1 including the splicer head assembly.
Figure 6:
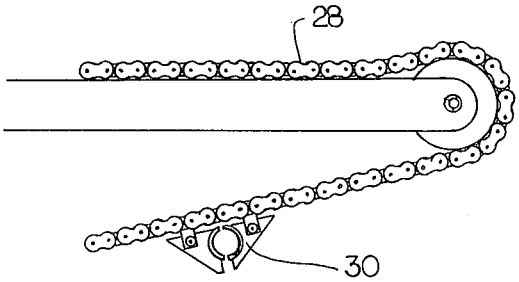
FIG. 6 is a partial enlarged view of the chain and roll shaft gripping device of the invention.
Figure 7:
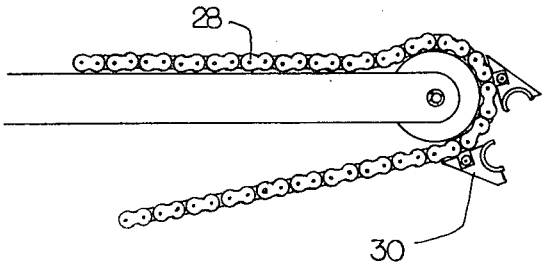
FIG. 7 is a sequential view of the gripping device shown in FIG. 6 showing the gripping device opened by gravity.
Figure 8:
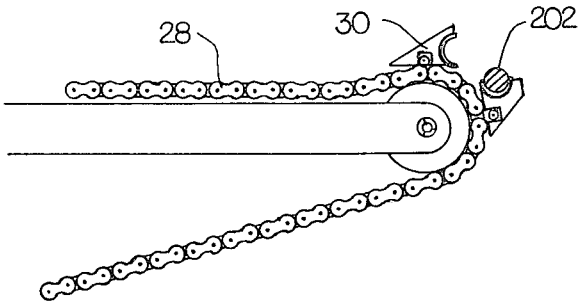
FIG. 8 is a sequential view of the gripping device shown in FIG. 7 with the roll shaft mounted thereon.
Figure 9:
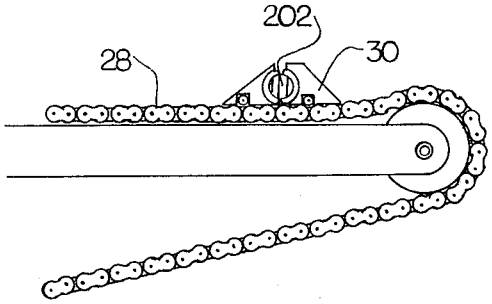
FIG. 9 is a sequential view of the gripping device shown in FIGS. 6 through 8 gripping and lifting the shaft and roll of material to be spliced up the roll stand.

The present invention is shown in FIGS. 1 through 10 and the preferred embodiment and best mode of the invention is shown in FIGS. 1 through 9. In the invention an automatic splicer apparatus 10 is shown incorporating a duplex roll stand 12 and an integrally mounted splicer assembly 14. The apparatus 10 utilizes standing splicing and provides for reduction in the speed differential between the expiring moving web and the new standing web without the use of a festoon or accumulation web.

The roll stand 12 is provided with a support frame 16 consisting of two side members 17 mounted on a base 18 which is preferably bolted to the floor when in an operating condition. Each side frame 17 is provided with upright slicer assembly support members 20, 21, and a roll support member 22.

Roll conveyor assemblies 24 are positioned within the side frames 17. Each roll conveyor assembly 24 is formed with an inclined bar support 25 secured to support members 21 and 22 and further secured to and supported by an interior upright member 26. An endless chain 28 having a plurality of two-piece shaft gripping saddles 30 mounted thereon which are best seen in FIGS. 6 through 9, is rotatably mounted on sprockets 29 which are in turn rotatably mounted to the ends of incline bar support 25 through a standard bracket configuration. The chain 28 is also mounted on sprocket 31 which is rotatably mounted to a pulley assembly 33. The pulley assembly 33 is in turn rotatably mounted to an ear 23 secured to upright member 22. The two conveyor assemblies 24 carry a new roll of material 200 into position A and move the expiring or old roll of material to an end position B. After the film web 101 has been dispensed from the old roll, the finished shaft 102 of the expired roll 100 is dropped onto catch arms 34 which are welded to support members 22. Each chain 28 is driven by a standard state-of-the-art electric motor 32 which drives the sprocket 31 and pulley assembly 33 by means of a standard belt or chain drive 36 to rotate the endless chain 28.

A web speed differential assembly 38 is mounted on the support frame. The web differential assembly 38 comprises arms 39 pivotally mounted to pins 40 extending outward from standards 26. Each arm 39 is spring biased by a spring 41 having one end fastened to the arm 39 and the other end fastened to a mounting 43 secured to standard 26. The spring loaded arm 39 is connected to and biases swing arm 44. The swing arms are connected together by roller 47. A pneumatic cylinder 45 has one end mounted to the base 18 by appropriate means and the other end connected to a linkage 46 for transporting the swing arm 44 to a desired position against the tension of spring 41, during the splice preparation stage. The roll stand 12 is additionally equipped with a mechanism (not shown) well known in the art to center the roll of material for alignment and a standard brake to provide braking for controlled tension on the web so that it will not freewheel when the apparatus is stopped to provide suitable tension on the web of material as it unwinds.

In operation of the roll stand, the expiring roll 100 and the new roll 200 of material are provided with shafts 102 and 202 respectively through their mandrels (pre-shafted). The new roll 200 is brought to the leading lower end of the roll stand (point A) and the lifting and positioning chain 28 is advanced to bring the shaft gripping saddles 30 into engagement with shaft 202. The gripping saddle 30 was previously opened when passing point C due to the force of gravity on the gripping jaws separating the jaws as they pass around the circumference of the chain sprocket 31. The roll 200 is rolled into the saddles 30 so that the saddle jaws engage the shaft 202 ends. The chains 28 and associated saddles 30 lift the new roll 200 off of the ground directly under the splicer assembly 14. Swing arm 44 is transported to position 44(*a*) as shown in FIG. 1 in phantom by activating pneumatic cylinder 45 causing linkage 46 to drive the swing arm 44 and its associated roller 47 rearward allowing the film web 201 to be positioned rearward of roller 47 for splice preparation of the leading edge of the replacement web in the splicer assembly 14. The swing arm provides for a controlled and smooth acceleration of the web of the new roll of material at the time of the splice. The spring loaded spring arm can be adjusted to reduce the tension on the web of the new roll of material as it is accelerated during the splice cycle. This splice preparation step will be fully explained later on in the application in the discussion of operation of the splicer. After the splice preparation step the swing arm 44 is retracted to its original start position.

The splicer head assembly is constructed of two side frame members 48 each of which has a perpendicular base 37 which is welded to supports 20 and 21. Idle rollers 50 and 54 connect each of the side frames 48 and are rotatably mounted thereon. A pneumatic cylinder support shaft 55 supports and connects both of the side frames members 48 and is welded to the side frames. One of the side frame members 48(*a*) is provided with a slot 43 through which knife back up bar 56 can be slid. Ears 42 are secured to the frame member 48(*a*) adjacent to the slot and have mounted thereon a plurality of roller members 57 which support the knife back up bar 56 on surfaces 56(*a*) and 56(*b*). The knife back up bar is manually opened to permit splicing always on one side of the web. Two rotatable cutter support members 49 are rotatably mounted around shaft 53 of idle roller 54. The cutter support members 49 support rubber splicer roller 52 and a blade guide assembly 64. The blade guide assembly 64 holds an eccentric shaft and cam assembly 65 which is mounted in a slot 66 defined in guide plates 63 of the guide assembly. An adjuster assembly 67 is mounted to support member 49 and is provided with a thumb screw set 68 which is adapted to engage a standard pin and linkage well known in the art to drive plate 63 upward or downward with respect to frame members 48 around a pivot point 69 so that a knife bar 60 mounted to plate 63 and its associated knife blade member 62 has its height and angle changed allowing either more or less of the expiring old roll web to be cut so that there will be a variable splicing overlap for use with the new roll.

The support members 49 are driven by a pneumatic cylinder 70 which is mounted to a support bar 72 which is in turn secured to the aforementioned connecting shaft 55. A piston 74 of the cylinder member is secured to a drive shaft 76 which is mounted to both support members 49 so that expansion and retraction of cylinder 70 causes the drive shaft 76 and its associated support members 49 to rotate around shaft 53. A spring bar 78 is secured to shaft 76 with the other end of the spring bar being provided with a hook linkage which is mounted to one end of a spring 82. The other end of spring 82 is mounted via appropriate means known in the art to the knife blade member 62 so that the knife blade is continuously placed under tension pulling it away from cutting slot 59 defined by the knife bar member 56. When the pneumatic cylinder 70 is expanded, shaft 76 is driven forward causing the associate knife bar 60 to cam at point E against the inside edge of the knife back up bar 56 driving a knife blade 62 forward through cutting slot 59.

In the splicer assembly 14 the web 101 from the expiring roll 100 is threaded around idler roller 50, rubber splicing roller 52 and an upper idle roller 54. The new web 201 is threaded around the spring loaded swing arm 44, brought upwards behind the knife backup bar 56 and held by the vacuum splicer bar 58. Double sticky back tape is applied to the web by an operator at point D. Thus the splice is always made from one side, a top splice.

During the splice actuation, air cylinder 70 moves the splicer swing arm mechanism forward. Knife bar 60 contracts the knife backup bar 56 at point E to clamp and tension the web 101 for cutting at which time the knife bar 60 rotates counterclockwise and the serrated knife blade 62 swings or extends through slot 59 of knife bar member 56 cutting the expiring web 101 under tension. The splicer rubber roller 52 also being driven forward carries web 101 to contact the vacuum splicer bar 58 at the point D where the adhesive double sticky back tape is fixed or adhered to new web 201. The momentum of movement in the rubber splicing roll 52 affixes the double sticky back tape and starts the new web in motion. The vacuum splice bar 58 is rotated to a stop position and is caught by a latch 64. The splice is completed and the air cylinder 70 retracts to move the support arm mechanism back to a rest position removing the clamping action on the webs.

The spring loaded swing arm 44 is carried by the tension of the new web to a position 44(*a*) shown in phantom. This movement under spring tension permits a gradual acceleration in the web of new roll 200 to eliminate jerking or snatch on the splice joint as the leading edge of the new web of material is accelerated to the expiring web speed. The knife back up bar 56 is withdrawn from the side of the splicer frame allowing web 201 to pass over idle rollers 50 and 54, and the roll is carried up the conveyor assembly to point B. Swing arm 44 is returned to its operating position from position 44(*a*) and the knife back up bar is returned to operating position within the frame of the splicer assembly for a subsequent splice. The knife holding arms 63 can be adjusted to move the knife blade 62 upwards or downwards to shorten or lengthen the splice overlap tail. The eccentric cam and shaft 65 aligns the arms 63 as one of the arms is adjusted so that the cutting blade is aligned from one frame member to the next. It should be noted that no air source for the pneumatic cylinders 45 and 70 has been discussed nor has the fluid circuitry to operate such cylinders been disclosed. Such reservoirs and circuitry are well known and standard in the art and need not be discussed.

Figure 10:
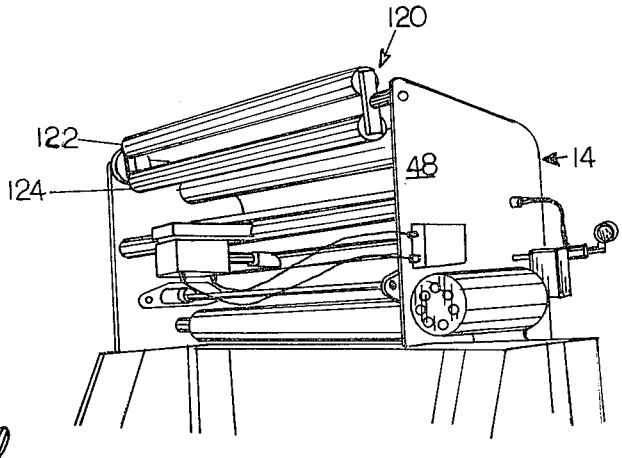
FIG. 10 is a perspective view of the rear of the splicer assembly with a festoon assembly for use in an alternate embodiment of the invention.

An alternate embodiment of the invention is shown in FIG. 10. In this embodiment, a festoon assembly 120 is disclosed which is to be used in place of spring arm 44. Festoon assembly 120 comprises a suitable magazine which stores a supply of running web so that the magazine plays out the web while the apparatus makes a splice. The festoon apparatus comprises a set of rollers 122 and 124 which loop and thereby store substantial length of the running web downstream of the advancing rollers of the splicing head apparatus.

While the preferred embodiment of the invention has been disclosed, it is understood that the invention is not limited to such an embodiment since it may be otherwise embodied in the scope of the appended claims.

What is claimed is:

1. A splicing apparatus for making uniform splices on the same web side comprising a roll stand with a splicer assembly mounted thereon said roll stand comprising a frame, a material roll conveyor assembly mounted on said roll stand, moveable film reservoir means mounted on said roll frame, said film reservoir means comprising a moveable tensioned arm member adapted to engage the leading end of a web of a replacement roll to form a web loop, said splicer assembly comprising a frame secured to said roll stand frame, a plurality of idle rollers rotatably mounted to said splicer assembly frame, means to hold the leading edge of a web of replacement roll material positioned adjacent the web of the expiring roll, moveable clamp means mounted to said splice assembly frame, means to move said clamp means to clamp the expiring web and replacement web together between said holding means and said moveable clamp means, and cutter means to sever said expiring web between said expiring roll and said clamp means, wherein said splicer assembly comprises a plurality of upstanding side members secured to said roll stand frame, a plurality of idle rollers mounted to said side members, a rotatable vacuum member mounted to said side members, a knife back up bar slidably mounted within at least one of said side members and adapted to engage the other side member, and clamping and cutting means rotatably mounted to said side members, said cutting and clamping means comprising a pivotable support member mounted to each of said side members, a connecting member secured to and connecting said pivotable support members, means connected to said connecting member adapted to drive said support members and move said clamping and cutting means, a knife blade moveably mounted to said support members and blade adjustment means moveably mounted on at least one support member.

2. Apparatus as claimed in claim 1 wherein said blade adjustment means comprises a moveable slotted track member mounted on each of said support members, adjustment means connected to at least one of said track members adapted to move said track member upward and downward to adjust the blade member mounted thereon, and an eccentric cam and shaft member mounted in a slot track defined in each of said track members, said eccentric cam and shaft member adjusting said track members and the blade member mounted thereon so that the blade extends between said support members at a constant angle and height.

3. Apparatus as claimed in claim 2 wherein said knife blade comprises a moveable knife blade mounted on a cam member pivotally mounted to said track member, said cam member being adapted to engage one side of a knife back up bar to clamp the expiring web therebetween and drive said knife blade forward through a slot defined in said knife back up bar severing said web.

4. Apparatus as claimed in claim 1 wherein said drive means comprises a pneumatic cylinder secured to a support bar, said support bar being secured to a connecting member fixedly secured to each of said side members.

5. Apparatus as claimed in claim 1 wherein said knife blade is biased rearwardly by spring means, said spring means being connected to the rear end of said knife blade and said connecting member.

6. Apparatus as claimed in claim 1 wherein said knife back up bar comprises a slidable member mounted on rollers rotatably mounted to ears secured to at least one of said side members, said rollers engaging the top surface of a cutting slot defined by said knife back up bar and the bottom surface of a clamp surface cross piece of said knife back up bar.

7. Apparatus as claimed in claim 1 wherein said knife back up bar is provided with a rotatable roller at its lower extremities.

8. Apparatus as claimed in claim 1 including a festooning roller assembly mounted to said side frames, said festooning roller assembly comprising a plurality of rollers mounted to a stand which is rotatably mounted to a shaft, said festooning roller assembly being threaded with the web of the replacement roll to provide a reservoir of additional material.

9. A splicing apparatus for making uniform splices comprising a roll stand frame and a splicer assembly mounted on said roll stand frame, said roll stand frame comprising a base, a plurality of upright members extending from said base, a material roll conveyor assembly means mounted to said upright members, said conveyor assembly means comprising a plurality of inclined support members secured to said upright members, a plurality of sprockets mounted on each of said inclined support members, said sprockets together with at least one sprocket mounted on said roll stand frame being provided with an endless chain mounted thereon, said endless chain being driven by motor means which drives one of said sprockets and said chain, a plurality of shaft gripping members mounted on said endless chain, said shaft gripping members being provided with two separate sections which are separated to provide a widened saddle area adapted to grasp the shaft of a roll of material, and a moveable tensioned arm member adapted to engage the leading edge of a web of a replacement roll to form a web loop, said arm member being tensioned by spring means connected thereto to bias said arm member in one direction and cylinder means connected to said arm member by linkage means adapted to drive said arm member in the opposite direction from the spring bias, said splicer assembly comprising a plurality of upstanding side members secured to said roll stand frame, a plurality of idle rollers mounted to said side members, a rotatable vacuum member mounted to said side members, a knife back up bar slidably mounted within at least one of said side members and adapted to engage another side member, and a clamping and cutting means rotatably mounted to said side members, said cutting and clamping means having frame means comprising a plurality of moveable support members, each of said support members being moveably mounted to said side members, a connecting member secured to and connecting said moveable support members, and means to transport said support members to move said clamping and cutting means.

10. Apparatus as claimed in claim 9 wherein said clamping and cutting means includes a moveable slotted track member mounted on each of said support members, adjustment means connected to at least one of said track members to move said one track member upward and downward with respect to said support member, a blade means mounted on said track members, said blade means being provided with a cam member which is adapted to engage one side of said knife back up bar to clamp the expiring web therebetween and a knife blade which is driven by said cam member forward through a slot defined in said knife back up bar to sever the expiring web.

11. Apparatus as claimed in claim 10 wherein said adjustment means connected to at least one of said track members comprises an eccentric cam and shaft member mounted in a slot track defined by each of said track members, said eccentric cam and shaft member adjusting said track members and blade means mounted therebetween so that the knife blade extends between said support members at a constant angle and height with respect to the side members.

12. Apparatus as claimed in claim 11 including thumb screw means mounted to said support member and connected to one of said track members adapted to adjust said one track member upward or downward along the plane of said side member.

* * * * *